US007077668B2

(12) United States Patent
Lapidot et al.

(10) Patent No.: US 7,077,668 B2
(45) Date of Patent: Jul. 18, 2006

(54) BOARD MOUNTED ELECTRICAL CONNECTOR

(75) Inventors: Doron Lapidot, Tokyo (JP); Masayuki Aizawa, Tokyo (JP); Masashi Inoue, Kanagawa (JP)

(73) Assignee: Tyco Electronics AMP K.K., Kanagawa-Ken (JP)

( * ) Notice: Subject to any disclaimer, the term of this patent is extended or adjusted under 35 U.S.C. 154(b) by 0 days.

(21) Appl. No.: 11/144,339

(22) Filed: Jun. 3, 2005

(65) Prior Publication Data

US 2005/0272286 A1 Dec. 8, 2005

(30) Foreign Application Priority Data

Jun. 3, 2004 (JP) ..... 2004-165512

(51) Int. Cl.
*H01R 4/66* (2006.01)

(52) U.S. Cl. ..... 439/108

(58) Field of Classification Search ..... 439/108, 439/608, 79, 941

See application file for complete search history.

(56) References Cited

U.S. PATENT DOCUMENTS 6,350,134 B1 * 2/2002 Fogg et al. ..... 439/79
6,752,654 B1 * 6/2004 Huang et al. ..... 439/541.5
2002/0123254 A1 9/2002 Kato et al.

* cited by examiner

*Primary Examiner*—Tho D. Ta
(74) *Attorney, Agent, or Firm*—Barley Snyder LLC

(57) ABSTRACT

A board mounted electrical connector includes signal contacts, grounding contacts, and an insulative housing for holding the signal contacts and the grounding contacts. At least one pair of signal contacts and a grounding contact corresponding to the pair of signal contacts are arranged in two rows at an engagement portion of the insulative hosing. Leg portions of the signal contacts and the grounding contacts, which are to be mounted onto a circuit board, are arranged in three rows at positions closest to an engagement surface of the insulative housing to positions furthest from the engagement surface. Leg portions of the grounding contacts are provided in the first row closest to the engagement surface.

6 Claims, 6 Drawing Sheets

BOARD MOUNTED ELECTRICAL CONNECTOR

FIELD OF THE INVENTION

The present invention relates to a board mounted electrical connector.

BACKGROUND

There is a known board mounted electrical connector disclosed in U.S. patent application Publication No. 2002/0123254. That electrical connector provides a plurality of pairs of differential signal transmission contact s along with grounding contacts which are positioned adjacent to each pair of the differential signal transmission contacts. The pairs of the differential signal transmission contacts and the grounding contacts are provided in two rows along an engagement portion. The leg portions of the contacts are arranged in three rows at the side of the connector to be mounted onto a circuit board.

The leg portions of the board mounted electrical connector are positioned such that the grounding contacts are arranged in a second row, and the signal contacts are arranged in a first row and a third row. The first row is closest to an engagement surface, and the third row is farthest from the engagement surface. Due to this construction, it is necessary for conductive traces on a circuit board, to extend from the first row to pass through grounding patterns of the second row and signal patterns of the third row. In applications requiring high density arrangement of the leg portions, it is practically impossible to form these signal patterns on a single layer of the circuit board. A multi layer circuit board having the grounding pattern formed at an interior layer of the circuit board and signal patterns formed on an outer layer(s) could be used to address this issue. However, multi layer circuit boards will increase the cost to manufacturer the electrical connector. In addition, in the case that a multi layer circuit board is to be utilized, two layers become necessary to form signal patterns thereon. Therefore, the degree of freedom in circuit board design will be reduced.

SUMMARY

The present invention has been developed in view of the circumstances above. It is an object of the present invention, among others, to provide a board mounted electrical connector that enables formation of signal patterns on a single layer of a circuit board, on which the electrical connector is to be mounted.

It is another object of the present invention to provide a board mounted electrical connector which is superior in transmission properties.

It is still another object of the present invention to provide a board mounted electrical connector which is capable of matching characteristic impedances of signals transmitted within the electrical connector.

The board mounted electrical connector of the present includes signal contacts grounding contacts and an insulative housing for holding the signal contacts and the grounding contacts. Two rows of the grounding contacts are provided to correspond to at least one pair of the signal contacts at an engagement portion of the insulative housing. Leg portions of the signal contacts and the grounding contacts, to be mounted on a circuit board, are provided in three rows from a position closest to an engagement surface of the insulative housing to a position farthest from the engagement surface. The leg portions of the grounding contacts are provided in the first row closest to the engagement surface.

Here, the "rows" include cases in which a single contact is provided in a row, in addition to cases in which a plurality of contacts are provided in a row.

DETAILED DESCRIPTION OF THE EMBODIMENT(S)

Figure 1:
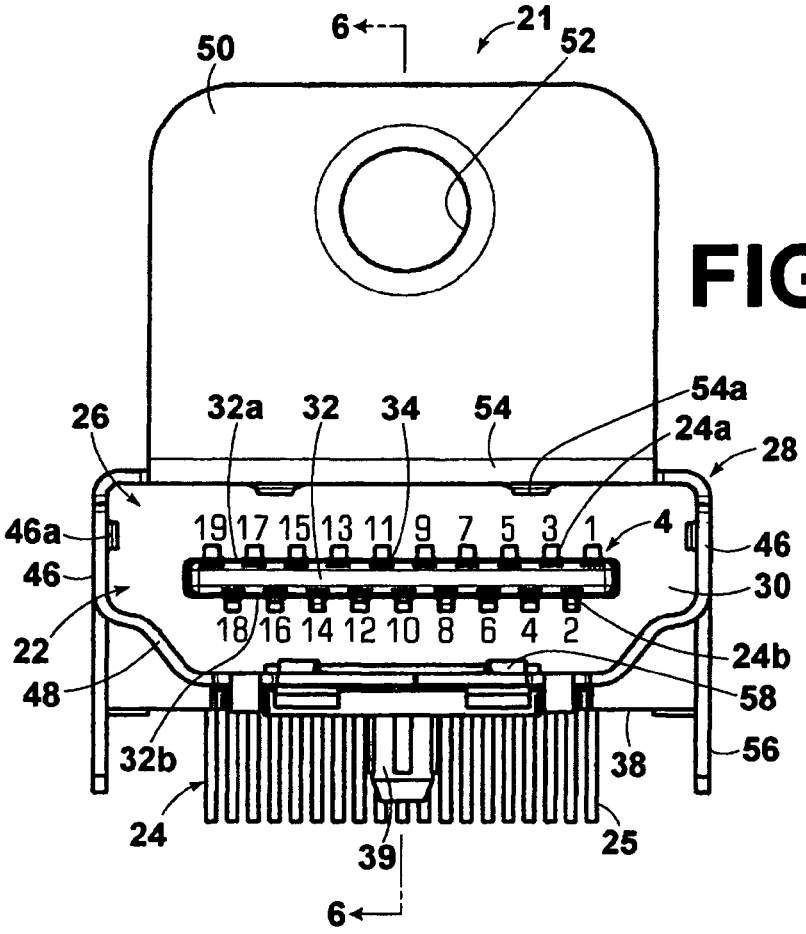
FIG. 1 is a front view of a board mounted electrical connector of the present invention.
Figure 2:
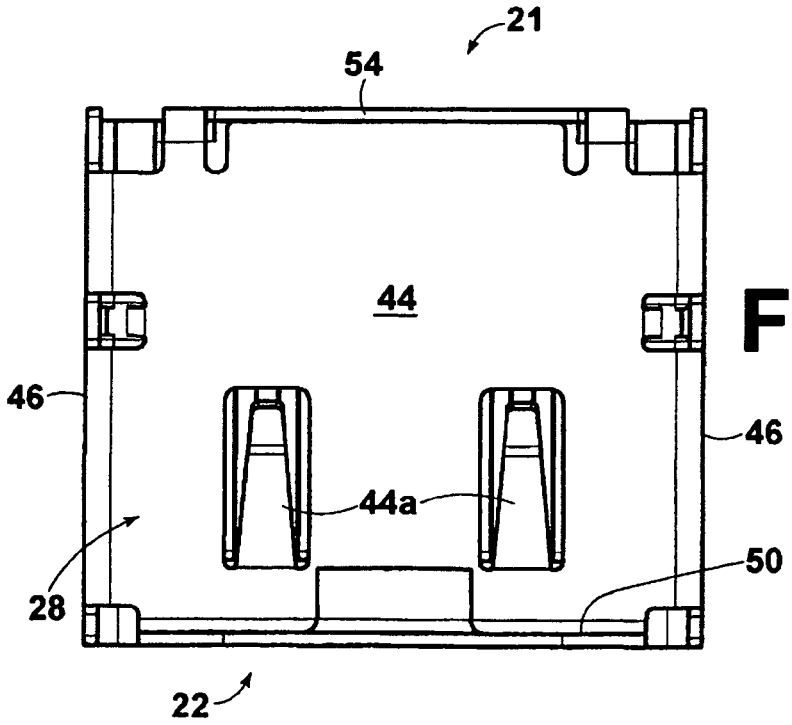
FIG. 2 is a plan view of the board mounted electrical connector of FIG. 1.

An embodiment of the board mounted electrical connector according to the present invention will now be described with reference to the attached drawings. Referring first to FIG. 1 through FIG. 6, the connector 21 comprises: a plurality of contacts 24 (differential signal transmission contacts 24*a* and grounding contacts 24*b*); an insulative housing 26 (hereinafter, simply referred to as "housing") for holding the contacts 24; and a metallic shell 28 that covers the housing 26. The shape of an engagement portion 22 of the connector 21, to be connected to another connector (not shown) is defined by the HDMI (High Definition Multimedia Interface) format.

Figure 3:
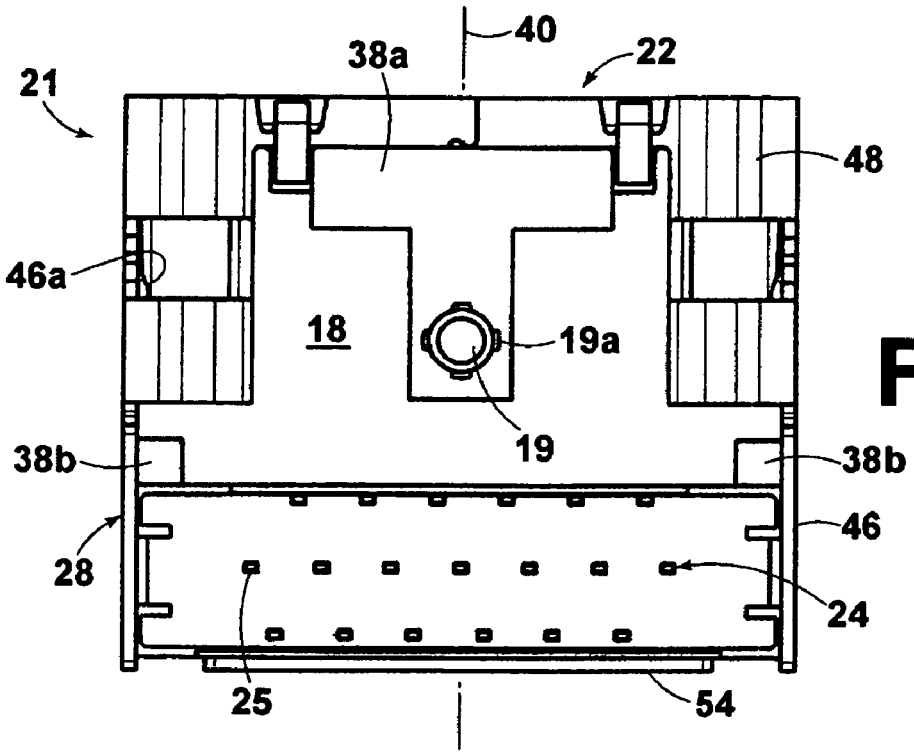
FIG. 3 is a bottom view of the board mounted electrical connector of FIG. 1.
Figure 4:
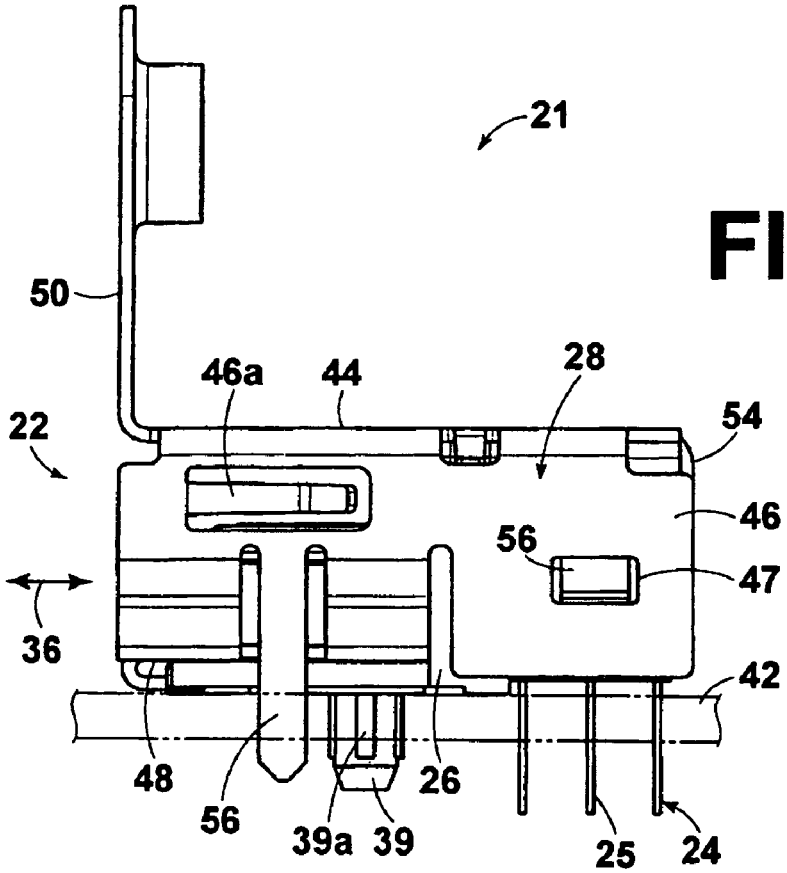
FIG. 4 is a right side view of the board mounted electrical connector of FIG. 1.
Figure 5:
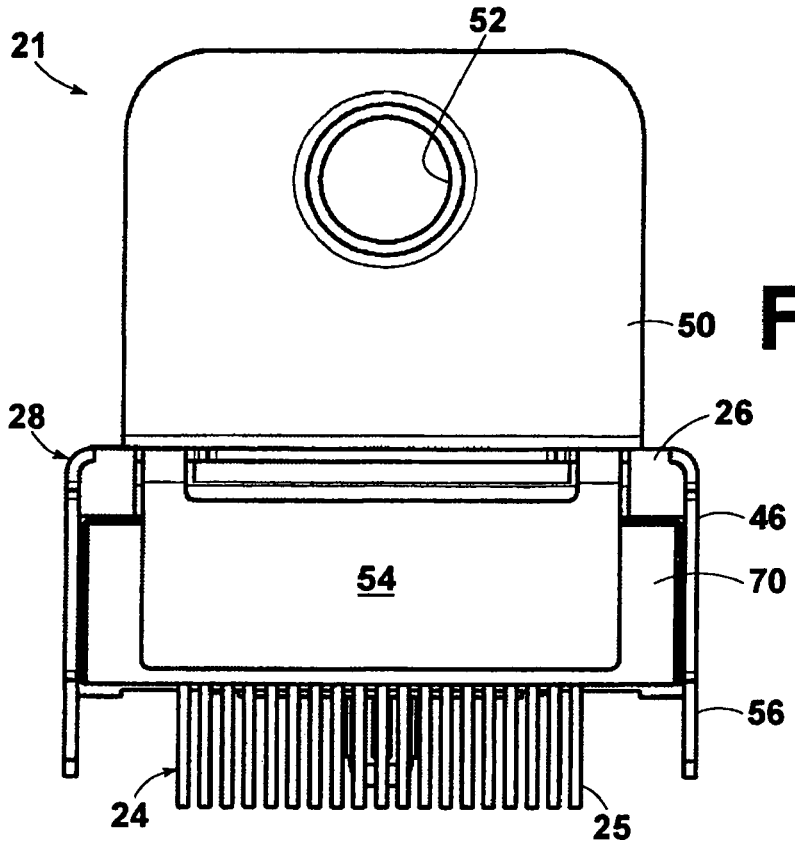
FIG. 5 is a rear view of the board mounted electrical connector of FIG. 1.

The housing 26 has a main body 30 and a planar portion 32 that protrudes into the approximate center of an engagement recess 22*a* (refer to FIG. 6) located in the engagement portion 22. A plurality of contact housing grooves 34 are formed at a predetermined spacing on the upper surface 32*a* and the lower surface 32*b* of the planar portion 32. The contact housing grooves 34 extend in an insertion direction 36 (refer to FIG. 4). The contacts 24 are located within the contact housing grooves 34. The arrangement of the contacts 24 will be described later. As illustrated in FIG. 3, protrusions 38*a* and 38*b* that protrude for equal distances are formed on a bottom wall 38 of the housing 26. The protrusion 38*a* is T-shaped in the vicinity of the engagement portion 22. The protrusions 38*b* are generally rectangular and are formed at the left and right ends toward the rear edge of the housing 26. The protrusions 38*a* and 38*b* abut a circuit board 42, when the connector 21 is mounted on the circuit board 42. That is, the protrusions 38*a* and 38*b* serve as standoffs. A downwardly facing cylindrical boss 39, which has ribs 39*a* around its periphery, is integrally formed with the protrusion 38*a*. The boss 39 is inserted into a positioning aperture 96 in the circuit board 42 when the connector 21 is mounted on the circuit board 42, to position the connector 21 (refer to FIG. 9).

Figure 6:
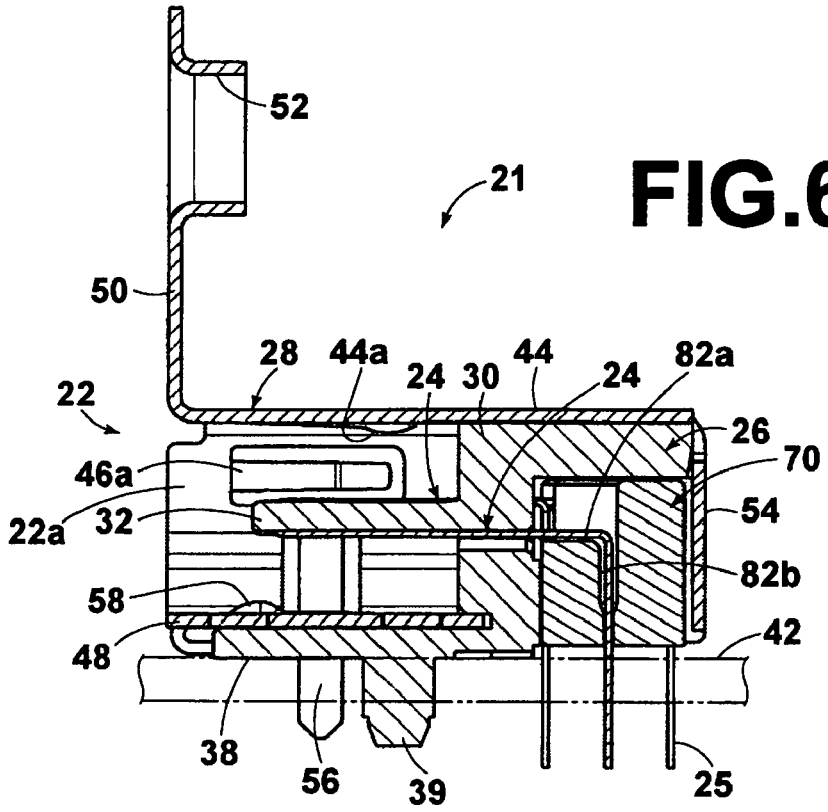
FIG. 6 is a sectional view of the board mounted electrical connector, taken along line 6—6 of FIG. 1.

The shell 28 is formed by stamping and forming a metal plate. The shell 28 comprises: an upper wall 44, which is generally rectangular; side walls 46, which are formed by bending the two lateral edges of the upper wall 44 downward; a bottom wall 48, which is formed by bending the side walls 46 inward; and a rear wall 54, which is formed by bending the rear edge of the upper wall 44 downward. As illustrated in FIG. 6, the housing 26 is contained within the shell 28. A pair of grounding tongues 44*a*, for establishing grounding connections with another connector, is formed on the upper wall 44 of the shell 28. In addition, a bracket 50 extends upward at a right angle from the upper wall 44 near the side of the engagement portion 22. A mounting aperture 52, for fixing the shell 28 to a frame (not shown) with a screw, is formed in the bracket 50.

Grounding tongues 46*a*, which are similar to the grounding tongues 44*a*, are formed on each side wall 46 of the shell 28. Downwardly extending mounting legs 56, which are inserted through mounting apertures 94 (refer to FIG. 9) of the circuit board 42 and fixed thereto and are formed on the side walls 46 toward the side of the engagement portion 22. The bottom wall 48, which extends from the lower ends of the side walls 46, are joined at a front portion thereof via a dovetail joint. The front portion of the bottom wall 48, at which the two sides are joined, is positioned toward the interior of the bottom wall 48 of the housing 26. Also as illustrated in FIG. 6, a cantilevered locking piece 58, for engaging with another connector and locking it to the connector 21, is formed at the front portion of the bottom wall 48 of the shell 28.

Figure 7:
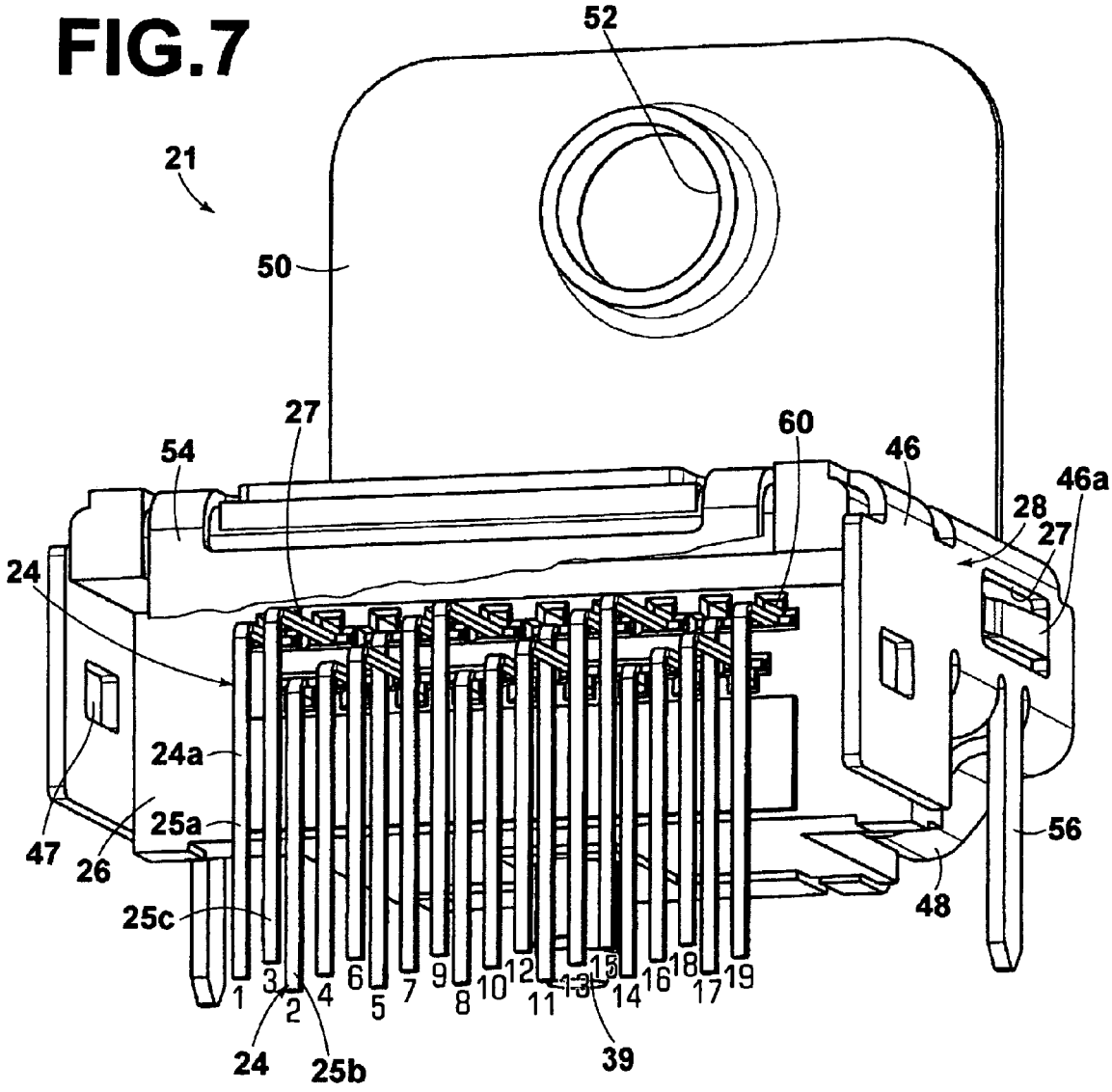
FIG. 7 is a perspective view from the lower rear side of the board mounted electrical connector of FIG. 1, with a leg aligning block removed therefrom.

FIG. 7 is a perspective view from the lower rear side of the connector 21. Note that a portion of the rear wall 54 is omitted from FIG. 7, to clearly illustrate the leg portions 25 of the contacts 24. The arrangement of the contacts 24 will be described in detail with reference to FIG. 1 and FIG. 7. The positions of the contacts 24 illustrated in FIG. 1 have been labeled with consecutive numbers from 1 to 19. The contacts 24, at positions labeled 1, 3, 4, 6, 7, 9, 10, 12 are differential signal transmission contacts 24*a*, and the contacts 24, at positions labeled 2, 5, 8, and 11 are grounding contacts 24*b*. A contact group is constituted by the pair of differential signal transmission contacts 24*a* at positions 1 and 3, and the grounding contact 24*b* at position 2, provided corresponding to the pair of differential signal transmission contacts 24*a*. In the connector 21 of the present invention, four such contact groups are formed. The four contact groups constitute the contacts for differential signal transmission. The signal contacts 24*a*, at positions 13, 15, 16, and 18 are low speed contacts. The contact 24, at position 14 is independent, that is, not connected to any other element. The contact 24, at position 17 is a grounding contact. The contact 24, at position 19 is a power source contact.

As illustrated in FIG. 7, contact cavities 60, through which the signal contacts 24*a* and the grounding contacts 24*b* are inserted, are formed in the housing 26 in two vertically separated rows. The leg portions 25 (25*a*, 25*b*, 25*c*) of the contacts 24 extend outward from the contact cavities 60 and are bent at right angles toward the circuit board 42 as illustrated in FIG. 3 and FIG. 7. The leg portions 25*a*, 25*b*, and 25*c* are arranged in a first row closest to the engagement portion 22, a third row furthest from the engagement portion 22, and a second row between the first and third rows. The arrangement into these positions is realized by varying the lengths of horizontal portions 27 of the leg portions 25 that extend rearward from the housing 26.

That is, signal contact 24*a* at position 21, which is the leftmost contact 24 in FIG. 7, has a leg portion 25*a* having a horizontal portion 27 of an intermediate length, thereby positioning the leg portion 25*a* in the second row. The leg portion 25*b*, of the grounding contact 24*b* adjacent to the leftmost signal contact 24*a*, has a horizontal portion 27 of the shortest length, thereby positioning the leg portion 25*b* in the first row. The leg portion 25*c* adjacent to the leg portion 25*b* has a horizontal portion 27 of the longest length, thereby positioning the leg portion 25*c* in the third row.

Figure 9:
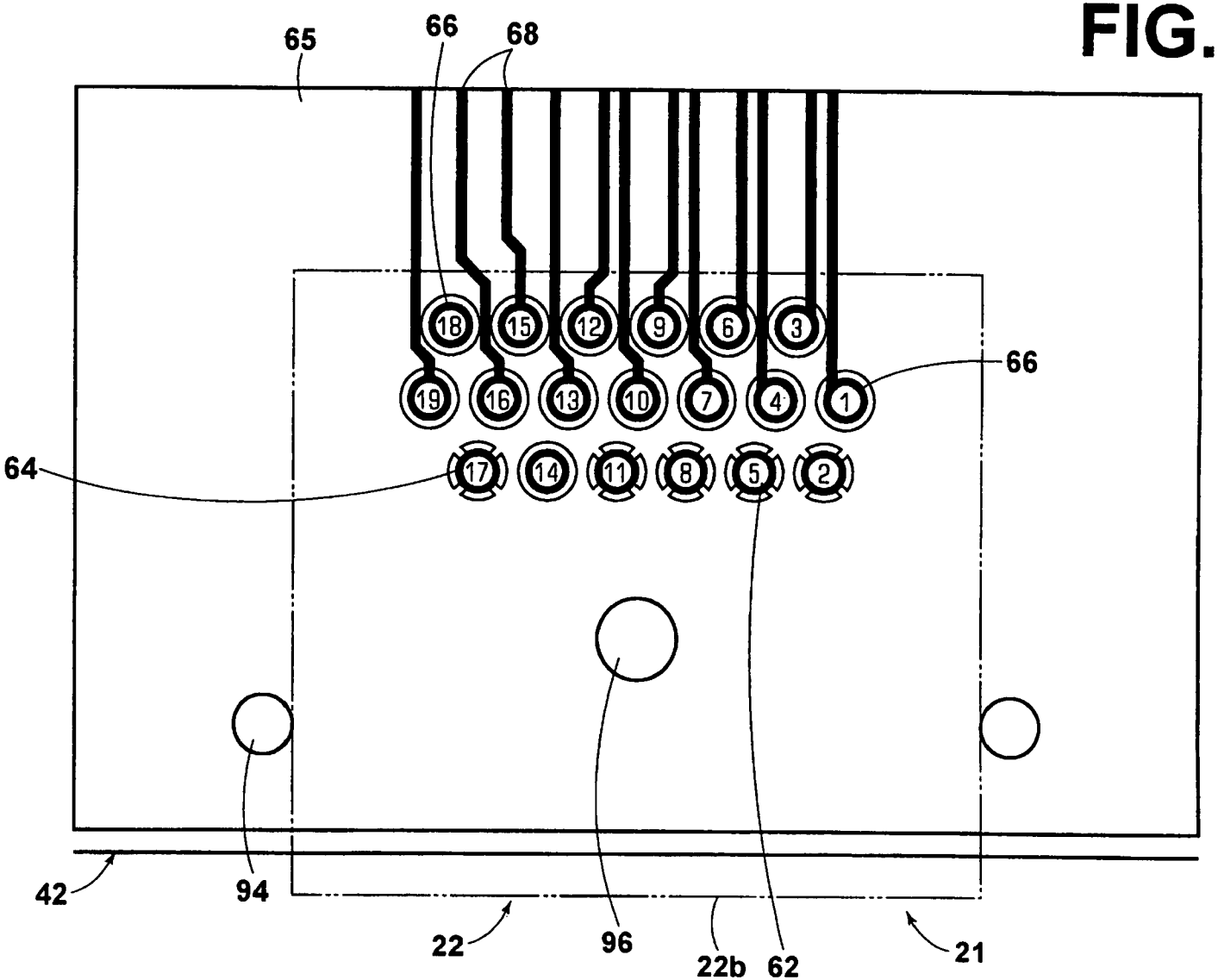
FIG. 9 is a plan view that illustrates the layout of plated through holes on a circuit board, to which leg portions of contacts are connected.

This arrangement as illustrated in FIG. 9 shows the layout of plated through holes 64 and 66, formed on the circuit board 42 on which the connector 21 is to be mounted. The outline of the connector 21, which is to be mounted on the circuit board 42, is denoted by broken lines in FIG. 9. Apertures 62, through which the leg portions 25 of the contacts 24 are inserted, are formed in the circuit board 42 in three rows. That is, the apertures 62 are arranged in a first row, closest to an engagement surface 22*b* of the engagement portion 22 of the connector 21, a third row, furthest from the engagement surface 22*b*, and a second row between the first and third rows. Each of the apertures 62 is labeled with numbers that correspond to the numbers of the positions illustrated in FIG. 1.

As is clear from FIG. 9, the leg portions 25*b* of the grounding contacts 24*b* are arranged in the first row, and the leg portions 25*a* and 25*c* of the signal contacts 24*a* are arranged in the second and third rows, respectively. The plated through holes 64, to be connected with the grounding contacts 24*b*, are formed on the rear surface of the circuit board 42. The plated through holes 64 are connected to a grounding region 65, which is provided across the entire rear surface of the circuit board 42. The plated through holes 66, to be connected with the signal contacts 24*a* of the second and third rows, are formed on the front surface of the circuit board 42, that is, the surface illustrated in FIG. 9. Conductive traces 68 extend toward the rear of the connector 21 from the plated through holes 66. The conductive traces 68 extending from the plated through holes 66 at positions 1, 4, 7, and 10 of the second row pass between the plated through holes 66 at positions 3, 6, 9, and 12 of the third row. These conductive traces 68 extend toward the rear of the connector 21 in close proximity to the conductive traces 68 extending from the plated through holes 66 of the third row. The close proximity of the conductive traces 68 cause the transmission properties of the differential signals to be improved.

Figure 8:
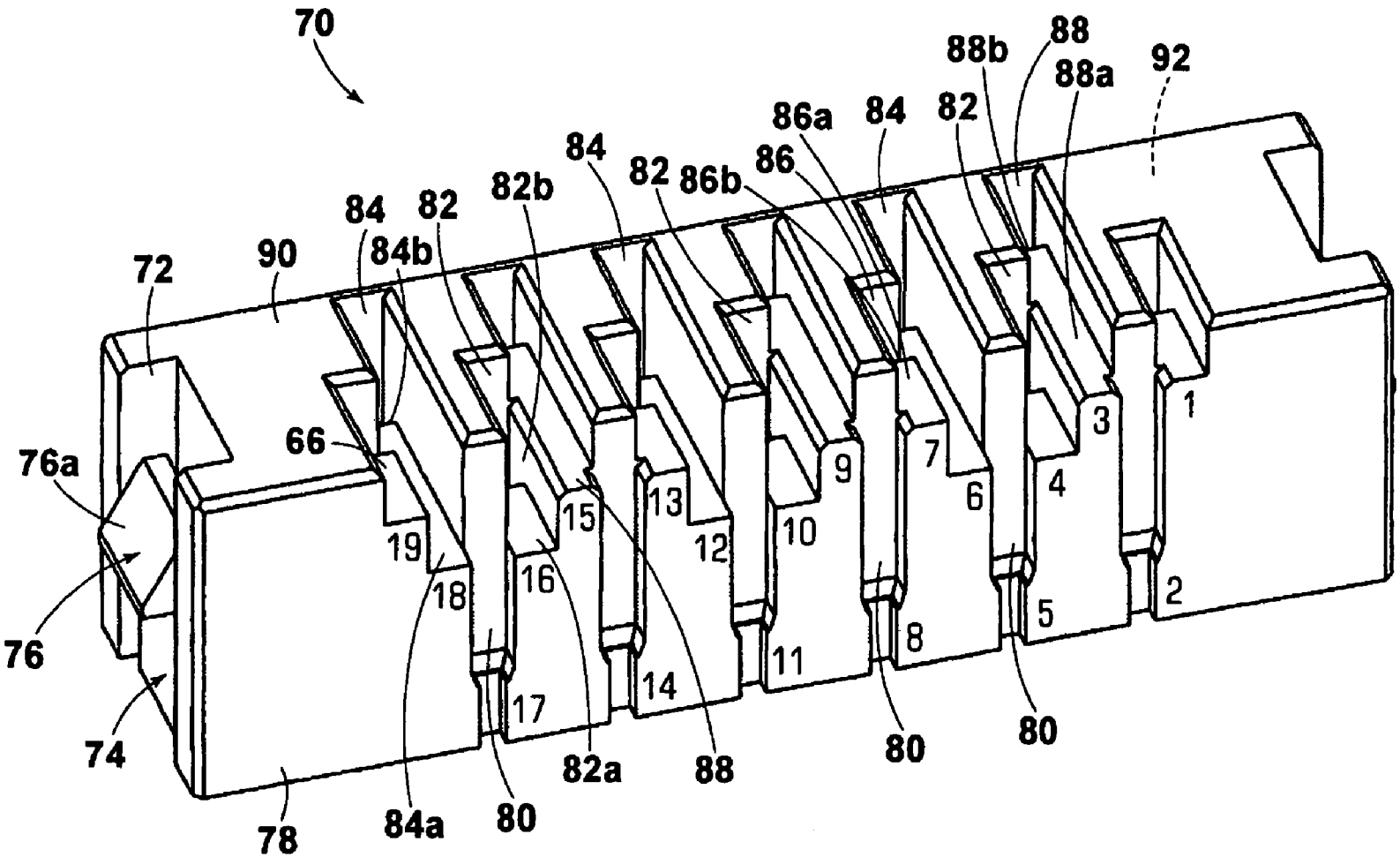
FIG. 8 is a perspective view from the front of a leg portion aligning block, which is utilized in the board mounted electrical connector of FIG. 1.

The leg portions 25 are constructed so as to be arranged in three rows in this manner. The positional relationships among the leg portions 25 are maintained by a leg portion aligning block 70 (hereinafter, simply referred to as "aligning block"). Next, the aligning block 70 will be described. FIG. 8 is a perspective view from the front of the aligning block 70, which is employed in the connector 21. The aligning block 70 is provided at the rear portion of the housing 26, and is shaped substantially as a parallelepiped. The aligning block 70 of FIG. 8 is arranged such that the front portion thereof is positioned toward the side of the housing 26, and the rear portion thereof is positioned toward the rear end of the connector 21. Vertically extending grooves 72 are formed at both ends in the longitudinal direction of the aligning block 70. Upwardly extending cantilevered latch arms 74 are formed within the grooves 72. Protrusions 76, having upwardly facing tapers 76*a*, are formed at the distal ends of the latch arms 74. The protrusions 76 engage with engaging openings 47 of the shell 28, thereby mounting the aligning block 70 to the connector 21.

Vertically extending aligning grooves 80 (housing portion), for receiving the leg portions 25*b* of the first row, are formed in the front surface 78 of the aligning block 70. The interior shape of the aligning grooves 80 is substantially complementary with the exterior shape of the leg portions 25*b*. Aligning grooves 82 and 84, for receiving the leg portions 25*a* and 25*c* of the second and third rows, are formed to the right and to the left of each aligning groove 80. The aligning grooves 82 and 84 are formed by cutting out the upper surface 90 and the front surface 78 of the aligning block 70. The aligning grooves 82 and 84 respectively have bottoms 82*a* and 84*a*, for placing the horizontal portions 27 of the leg portions 25 thereon. Aligning apertures 82*b* and 84*b* that penetrate downward in the vicinity of a rear surface 92 of the aligning block 70 are formed continuously with the bottoms 82*a* and 84*a*. Vertical portions of the leg portions 25 are inserted into the aligning apertures 82*b* and 84*b*. The aligning grooves 82 and 84 are for the signal contacts 24*a*, which are provided at the lower of the two rows of the contact cavities 60. Aligning grooves 86 and 88 for the signal contacts 24*a*, which are provided at the higher of the two rows of the contact cavities 60, are formed at heights corresponding to that of the upper row. Bottoms 86*a* and 88*a*, as well as aligning apertures 86*b* and 88*b*, are formed in the aligning grooves 86 and 88 in a similar manner as in the aligning grooves 82 and 84. Note that in FIG. 8, grooves corresponding to contacts are labeled with the numbers corresponding to positions 1 through 19, illustrated in FIG. 1 and FIG. 9.

The leg portions 25 of the contacts 24 are arranged in the aligning grooves 80, 82, 83, 86, and 88. Thereby, the wall of the aligning block 70, that is, the inner surfaces of the aligning grooves 80, the bottoms 82*a*, 84*a*, 86*a*, and 88*a*, and the aligning apertures 82*b*, 84*b*, 86*b*, and 88*b*, is positioned along the longitudinal direction of the leg portions 25. Accordingly, the leg portions are surrounded by the dielectric of the aligning block 70 to a certain degree. Therefore, characteristic impedances of the leg portions 25 are matched with those of the portions of the contacts 24, which are held in the housing 26. In other words, impedances increase at the thin leg portions that protrude from the housing 26 at high density. The increased impedances are decreased by surrounding the peripheries of the leg portions 25 with the walls of the aligning block 70, which is a dielectric. Thereby, the characteristic impedances of the differential signals can be matched.

The present invention exhibits the following advantageous effects.

The conductive traces (signal patterns) for the signal contacts of the second row need not pass through the plated through holes of the grounding contacts, and need only to pass through the plated through holes of the signal contacts of the third row. Therefore, formation of the signal patterns on a single surface of the circuit board is enabled and facilitated. In addition, the circuit board that the connector is to be mounted on need not be a multi layer circuit board, which will reduce costs. Even in the case that a multi layer circuit board is to be utilized, the signal patterns can be formed on a single layer, therefore increasing the degree of freedom in circuit board design. As a result, the area required for the signal patterns can be reduced, and other electric components may be mounted on the circuit board, or the circuit board may be miniaturized, thereby reducing costs.

In addition, a configuration may be adopted, wherein the leg portions of the paired signal contacts are provided in the second and third rows in close proximity to each other, from among the three rows of leg portions. In this case, signal patterns for the paired signal contacts can be provided in close proximity to each other, thereby improving transmission characteristics.

Further, a configuration may be adopted, wherein the insulative housing further comprises an insulative leg portion aligning block, for housing each of the leg portions; and the insulative leg portion aligning block comprises a wall that extends along the longitudinal direction of the leg portions, at a housing portion for housing the leg portions. In this case, the peripheries of the leg portions are surrounded by the leg portion aligning block, which is a dielectric. Thereby, characteristic impedances of the signals can be matched.

In the case that the signal contacts are differential signal transmission contacts, favorable signal transmission properties can be obtained.

What is claimed is:

1. A board mounted connector, comprising:

signal contacts;

grounding contacts arranged in rows;

an insulative housing for holding the signal contacts and the grounding contacts;

two rows of the grounding contacts corresponding to at least one pair of the signal contacts at an engagement portion of the insulative housing;

leg portions of the signal contacts and the grounding contacts, to be mounted on a circuit board, being located in three rows from a position closest to the engagement portion of the insulative housing to a position farthest from the engagement portion; and the leg portions of the grounding contacts being located in the first row closest to the engagement portion;

wherein the leg portions of the paired signal contacts are provided in the second and third rows in close proximity to each other.

2. A board mounted connector as defined in claim 1, wherein the signal contacts are differential signal transmission contacts.

3. A board mounted connector as defined in claim 1, wherein the insulative housing further comprises an insulative leg portion aligning block, for housing each of the leg portions; and the insulative leg portion aligning block comprises a wall that extends along the longitudinal direction of the leg portions, at a housing portion for housing the leg portions.

4. A board mounted connector as defined in claim 3, wherein: the signal contacts are differential signal transmission contacts.

5. A board mounted connector as defined in claim 1, wherein the insulative housing further comprises an insulative leg portion aligning block, for housing each of the leg portions; and the insulative leg portion aligning block comprises a wall that extends along the longitudinal direction of the leg portions, at a housing portion for housing the leg portions.

6. A board mounted connector as defined in claim 5, wherein: the signal contacts are differential signal transmission contacts.

* * * * *